US007735298B2

(12) United States Patent
Bräutigam

(10) Patent No.: US 7,735,298 B2
(45) Date of Patent: Jun. 15, 2010

(54) DEVICE FOR SEALING TRAY-SHAPED OR POT-SHAPED RECEPTACLES

(76) Inventor: Michael Bräutigam, Obernburger Straβe 40, 63853 Mömlingen (DE)

( * ) Notice: Subject to any disclaimer, the term of this patent is extended or adjusted under 35 U.S.C. 154(b) by 0 days.

(21) Appl. No.: 10/514,540

(22) PCT Filed: May 16, 2003

(86) PCT No.: PCT/DE03/01589

§ 371 (c)(1),
(2), (4) Date: May 10, 2005

(87) PCT Pub. No.: WO03/097460

PCT Pub. Date: Nov. 27, 2003

(65) Prior Publication Data

US 2005/0252171 A1 Nov. 17, 2005

(30) Foreign Application Priority Data

May 17, 2002 (DE) ..... 102 22 619

(51) Int. Cl.
*B65B 51/10* (2006.01)

(52) U.S. Cl. ..... 53/329.3; 53/329; 53/341; 53/367

(58) Field of Classification Search ..... 53/329, 53/329.2, 329.3, 300, 341, 360, 367
See application file for complete search history.

(56) References Cited

U.S. PATENT DOCUMENTS

| | | | | | |
|---|---|---|---|---|---|
| 3,248,851 | A * | 5/1966 | Ford | 53/329.3 |
| 4,642,353 | A * | 2/1987 | Berger | 548/431 |
| 4,930,288 | A * | 6/1990 | Juenkersfeld | 53/329.3 |
| 5,157,895 | A * | 10/1992 | Shibauchi et al. | 53/201 |
| 5,306,383 | A * | 4/1994 | Kobiella | 156/468 |
| 5,371,996 | A * | 12/1994 | Ueda et al. | 53/298 |
| 6,413,334 | B1 * | 7/2002 | Rittner et al. | 156/64 |
| 6,637,491 | B2 * | 10/2003 | Massey et al. | 156/581 |

* cited by examiner

*Primary Examiner*—Thanh K Truong
(74) *Attorney, Agent, or Firm*—Edwin D. Schindler

(57) ABSTRACT

An apparatus for sealing tray-shaped or pot-shaped receptacles, such as blister packs or pots for storing dairy products, includes a sealing head having a sealing contour support, a heatable sealing contour and support plate, preferably with at least one guide bolt immobilized thereon allowing for a linear displacement of the sealing head relative to the support plate. At least one spring element impinges the sealing head with a point biasing away from the support plate. A spring seat plate is disposed between the sealing head and the support plate and can be linearly displaced in the same direction as the sealing head. A rubber mount associated with the sealing head serves as a joint element and allows the sealing contour support to be tilted about the axes that are perpendicular to the guide bolts. An adjustable element is interposed between the spring seat plate and the sealing head.

10 Claims, 2 Drawing Sheets

DEVICE FOR SEALING TRAY-SHAPED OR POT-SHAPED RECEPTACLES

BACKGROUND OF THE INVENTION

Figure 1:
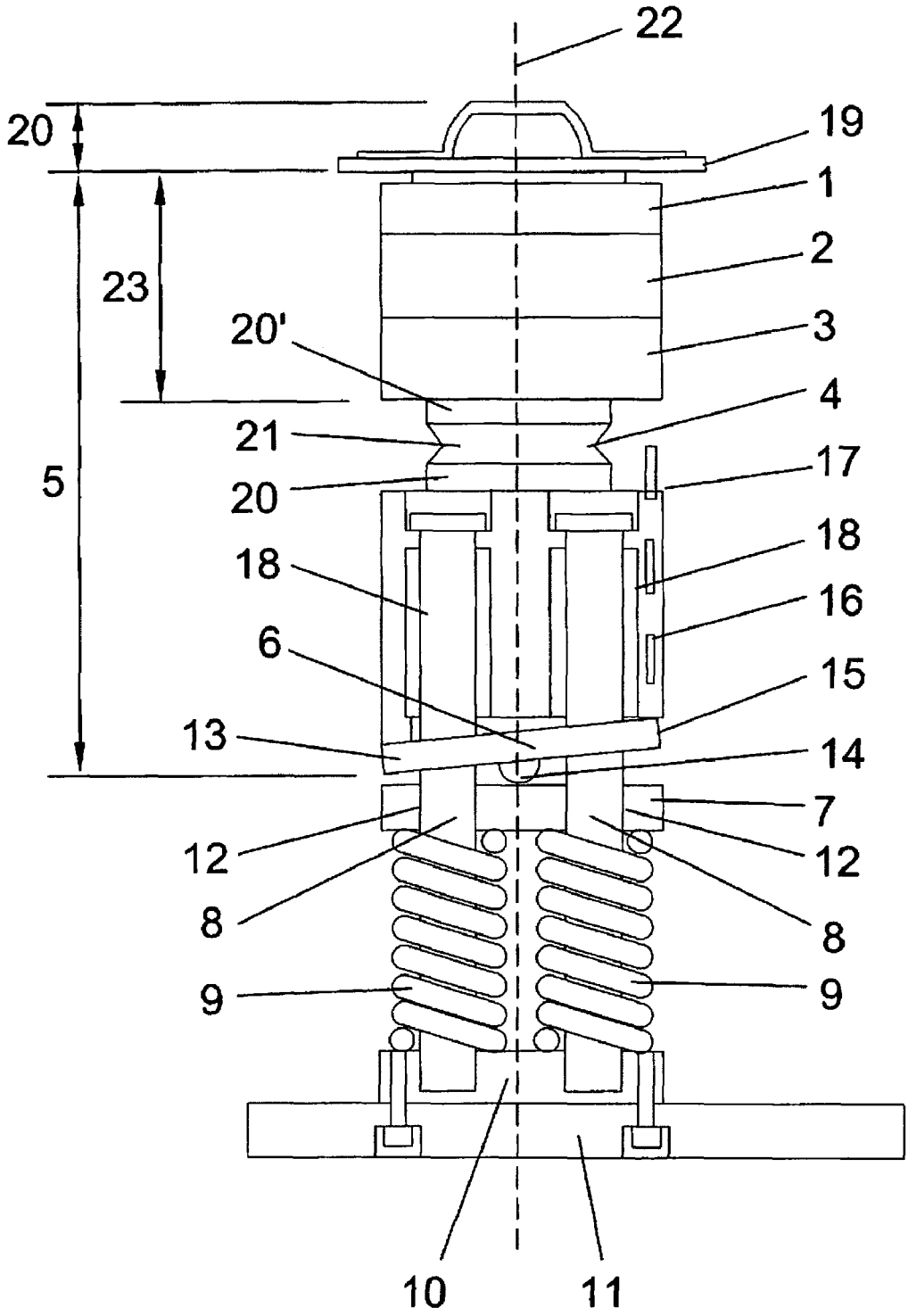

The invention relates to a device for sealing tray-shaped or pot-shaped receptacles, such as for example blister packs or pots for storing dairy products such as yoghurt, curd cheese or coffee cream. Said device is provided with a sealing head comprising a sealing contour support and a heatable sealing contour and a support plate with at least one guide bolt immobilized thereon which allows for a linear displacement of the sealing head relative to the support plate. At least one spring element impinges the sealing head with a force pointing away from the support plate. A spring seat plate is disposed between the sealing and the support plate and can be linearly displaced in the same direction as the sealing head. A rubber mount associated with the sealing head serves as a joint element and allows the sealing contour support to be tilted about the axis that are perpendicular to the aforementioned guide bolts. An adjusting element is interposed between the spring seat plate and the sealing head.

Blister packs are used for packaging of small components such as for example tablets, pills or buttons, but also sensitive or comparatively expensive components like lenses or electronic components. The mentioned packs consist of a more solid plastic dish with convexities where the remaining parts are kept and a foil cover which seals the convexities hermetically. In most cases the foil cover is glued onto the dish and has an adhesive film correspondingly which as a rule can be activated thermally. The strength of the bonding and/or of the foil cover is adjusted in such a way that on the one hand it adheres to the dish adequately and on the other hand can also be pulled off the dish.

In the same way pasty food which has comparatively small portions can be stored in receptacles which are closed with a foil cover which is easily removable. For example such packaging is used for yoghurt, curd cheese, coffee cream or ready-to-serve pudding.

For applying the foil cover sealing devices will be used which as a rule have several heatable sealing contours. The sealing contour has the task to press the foil cover with a defined force along the outline onto the dish or the cup rim and as a result of the adjusted higher temperature to glue the foil cover together with the receptacle. Sealing in the sense of this invention at issue means processes in which openings of receptacles will be closed with foils. In colloquial terms the notion bonding or welding is used.

In the actual technical state there exists a device for sealing blister packs, which consists essentially of a support plate and several sealing heads. There are bore holes in the support plate in which are guide bolts which are jointed firmly with a sealing head. This construction in hand allows a linear displacement of the sealing head relative to the support plate whereby between sealing head and support plate arranged springs which are enclosing bolts impinges the sealing heads with a force pointing away from the support plate.

Each sealing head has at its face pointing away from the support plate a heatable sealing contour plate. This construction in hand due to the actual technical state the heating is a semiconductor resistor heating and firmly integrated into the sealing contour plate. The setting of the sealing contour plate on the sealing head takes place with a cardan joint which is carrying out here as a ball which is arranged between two plate-formed elements of the sealing head. The ball makes tilting of the sealing contour plate with small angles possible, but also twisting the sealing contour plate about an axis which is perpendicular to the contour.

Sealing heads and support plate forming a unit which is for implementing the sealing attached on the foil cover of the blister pack. In this process each sealing head will come after attaching of the sealing contour into a rest position while the support plate will be shifted relatively to the sealing head and so far until the spring elements which are arranged between support plate and sealing heads produce the desired contact pressure of the sealing contours on the foil cover.

This construction due to the actual technical state have several disadvantages which lead to malfunctioning and production stop of the packaging machine.

Experience shows that an essential reason for malfunctioning lies in the construction of the heating. Particularly a problem is the contact of the resistor element which does not withstand the permanent temperature. Moreover the withstanding of the semiconductors turn out to be insufficiently small. The disadvantage consequence is that the heating often breaks down and therefore has to be changed. Due to the fact that sealing contour and heating are forming a unit, which moreover cannot be removed when built-in with the sealing head, for changing the heatable sealing contour there has to be a complete removal of the unit consisting of sealing heads and support plate. The disassembly requires much effort which costs money and there are also production stops of the packaging machine which cause high loss of production.

The unsatisfactory mechanical stability of the device due to the actual technical state has proven as a disadvantage. The setting of the sealing contour plate on the sealing head with the help of a ball joint makes the location of the sealing contour parallel to the foil cover possible. On the other hand it allows a twisting of the sealing contour plate about an axis which is perpendicular to the contour. This last mentioned possibility of motion has a special disadvantage because it hinders an exact location of the sealing contour relatively to the convexity of the lower plastic receptacle.

On the mentioned device can occur also problems with the exact set-up of the contact pressure of the sealing contour onto the foil cover. Herewith the spring path of the corresponding spring element must be adjusted with the help of screws which operate in axial direction of the spring. Due to the fact that these screws are not easily accessible the setting-up needs a considerable amount of effort and cannot be done during operation which is of great disadvantage.

The linear guiding of the sealing heads by guiding bolts whose ends are attached to a sealing head, each one individually. The other end of the guiding bolts which functions in a borehole of the support plate has not proven as a success. In this carrying out the unity out of sealing head and guiding bolt has a long lever arm which leads from the sealing contour to the guiding borehole in the support plate. Slight loose between borehole and guiding bolts causes the effect that the sealing contour can make considerable lateral motions. These motions also hinder an exact location of the sealing contour relatively to the convexity of the lower plastic receptacle.

SUMMARY OF THE INVENTION

Moreover the long lever arm can cause bending out of line of the guiding bolts in the guiding boreholes. Bending out of line causing an increase of friction between bolts and borehole whose amount is not yet defined. As a consequence the contact pressure of the sealing contour onto the cover foil fluctuates as well from contour to contour as at the same contour from cycle to cycle. Herewith the sealing quality is diminished disadvantageous.

Due to this background the invention will solve the task to have device for sealing blister packs which avoids the mentioned disadvantages and makes a simple and quick set-up of the contact pressure of the sealing contour possible also an improved sealing quality and a diminished failure frequency and consequently decreased costs for repair and maintenance.

Inventively this task will be solved with several, individually independent realizable steps. These solutions are marked by between each spring seat plate and sealing head there is an adjusting element
with which the distance of the spring seat plate can be adjusted relatively to the support plate and/or the joint element as rubber bearing
with two metal plates and a rubber layer between
whereas the plates are vulcanized or glued on and/or the heatable sealing contour which is assembled out of an independent contour plate and an independent heating plate
and both plates
separable connected with each other
and separable attached at the sealing contour plate.

The device due to the first suggestion starts from sealing equipment due to the actual technical state, which are provided with guiding bolts and spring elements, which enclose the bolts and are arranged between the support plate and the spring seat plate which adjoins the sealing head.

Differing to the actual technical state the inventive device has a spring seat plate with boreholes for moving along the guiding bolts or relatively to them and can—in the same way as the sealing head—be linearly displaced. The position of spring seat plate relative to the support plate defines the length of an spring element and therefore its initial tension.

An essential thought in this invention at hand is the realization of the spring seat plate and its adjustable position. Therefore between the sealing head and the spring seat plate there is an adjusting element which is easily accessible and with it the distance of the spring seat plate relatively to the sealing head and also to the support plate is adjustable and changeable. Displacing of the spring seat plate into the direction of the support plate leads to an increase and displacing away from the support plate to a decrease of the initial tension. The initial tension defines the after putting the sealing head onto the foil cover of the blister pack the contact pressure executed by the sealing contour on the foil cover. Consequently the mentioned adjusting element allows a set-up of the contact pressure of the sealing and the setting is quickly and simply done. Herewith a great advantage is the free and easy access to the adjusting element so that the set-up of the contact pressure can be adjusted while the sealing head is built-in.

With an advantageous advance of the inventive device the mentioned adjusting element encloses a single armed lever handle which is articulated on the sealing head (resp. the spring seat plate), whereas its first single armed lever handle pushes with its free end against the spring seat plate (resp. the sealing head) and its second armed lever handle with its free end against an adjusting screw. Due to an essential characteristic of the invention the adjusting screw is arranged such as that it is adjustable at the face of the sealing head which is the turned off side of the support plate.

With turning of the screw the incline of the lever is changed and then the free end of the first armed lever handle is displaced more or less in direction of the axis of the sealing head. The spring seat plate (resp. the sealing head) which is adjacent to the mentioned lever arm receives hereby also a translatory displacement and as a consequence the spring and the spring has a change of its initial tension. Herewith the displacement of the spring seat plate about the reduction ratio of both lever arms is more decreased than the change of position of the adjusting screw. The proposed device allows advantageously a more exact adjusting of the spring initial tension.

With defining the geometrical data of the lever it is proposed that the articulating point of the lever is arranged in an marginal area of the sealing head and that the adjusting screw is arranged in the opposite area of the sealing head and that the free end of the one lever arm lies in the area of the axis of the sealing head. This construction allows a very precise set-up of the contact pressure of the sealing contour onto the foil cover of the blister packs, typical measurements with devices in practice show a change of the spring initial tension about 25 Newton per turn.

The construction of the adjusting screw shows numerous possibilities. For the mentioned invention one solution has proven to be a success: the adjusting screw encloses a headless screw with hexagon socket head and a cylindrical pin which is adjustable from the axis. Here the cylindrical pin is arranged between the mentioned lever and the mentioned headless screw while the headless screw stands out from the tapped hole and it is in the area of its head with a locknut adjustable. With this construction the adjusting of the spring initial tension is adjustable with effortless ease and only a few grips which are as follows: loosen the locknut, adjust the headless screw about the necessary number of turns and subsequently set-up the locknut again.

For the sealing quality has besides an exactly measured contact pressure also a clean appliance of the sealing contour onto the foil cover a decisive meaning. The sealing contour plate has to make sure that the sealing contour is under all working conditions always parallel to the surface of the foil cover adjusted. Therefore normally the sealing devices have a joint element which allows tilting of the sealing contour plate about small angles.

This element is in the proposed device carried out due to an essential characteristic of this invention as a rubber bearing with two metal plates and a rubber layer between, whereas the plates are vulcanized or glued. This construction of the joint element makes on the one hand a tilting of the sealing contour in all directions possible perpendicular to the axis of the sealing contour but on the other hand no twisting of the contour about the mentioned axis. The proposed solution makes sure that the sealing contour is always parallel to the surface of the foil cover and in azimuth direction always an exact adjusting relative to the convexity of the lower plastic receptacle. Both characteristics make possible that the device due to the invention can produce high quality sealings.

It is proposed that in the construction of the rubber bearing both metal plates on the side which shows off the rubber layer there has to be a bolt which is concentric to the axis of the rubber bearing and which engages into a borehole of the same diameter in the sealing head resp. in the sealing contour plate. Due to the proposition each bolt has a slot with a dovetail for adjusting the rubber bearing to the adjacent elements. Therefore it is provided in each sealing head and in each sealing contour plate at least one thread-cutting screw which can be screwed against the mentioned flank. Bolts, dovetail slot, and mentioned screws together show a fast tension system which allows with simple means a secure and exactly positioned adjusting of the rubber bearing at its adjacent elements. These activities bring also the advantage that the rubber bearing can be changed easily for repair.

In an advantageous constructive advance of the inventive device the mentioned fast tension system has an additional caution against twisting of the rubber bearing: In this carrying out each metal plate outside the axis of the rubber bearing has a borehole in which engages a cylindrical centering pin which is adjusted at the sealing head and the sealing contour plate. These last mentioned constructive actions lead to a space and twist-free adjusting of the rubber bearing which have a high sealing quality as a result.

The proposed constructive activities of this mentioned invention for improvement of the sealing quality and for decrease of the failure frequency enclose also the heating of the sealing contour. As already shown has the inventive device a heatable sealing contour assembled out of an independent contour plate and an independent heating plate. Due to an essential characteristic of the invention both plates are separable jointed with each other and separable adjusted at the sealing contour plate. This carrying out has as a result an essential improvement for maintenance and repair, because of a defect of the heating or the thermostat only the heating plate has to be replaced. And there need not—as with sealing devices due to the actual technical state, the complete unit out of sealing head and support plate has to be build out, but only the defect heating plate. Because the contour plate and the heating plate are separably with each other joint, the disassembly and assembly of both elements need only a small amount of time an can be especially without disassembly of other elements of the device carried out.

DETAILED DESCRIPTION OF THE DRAWING FIGURES

An especially preferred constructive advance of the inventive device provides moreover with a drastic decrease of the number of repairs. In this carrying out the heating plate is a flat heating preferably formed as ceramics flat heating or heating plate with heating cartridge. Copper and/or aluminium is especially preferred as material for the heating plate and/or also for the flat heating due to their thermal conductance. Both carrying outs have a long endurance therefore a change of these elements is only in comparable large periods necessary. Long periods of production stops of the packaging machine and subsequently high loss of production caused by defect heating plates does not take place with the here mentioned inventive device.

There are further constructive actions with the same target namely increasing the endurance of the device as long as possible. These carry out that the contour plate consists of hardened material or out of a material which is resistant against aggressive substances preferably rustproof steal. The life of the contour, the resistance against mechanical stress and resistance against aggressive substances which can discharge within the sealing process out of the convexity of the plastic receptacle have increased to a higher value.

The usual temperatures during the sealing of blister packs have 200 centigrade Celsius. This temperature is during action permanently valid on the device at the contour plate. One characteristic of this invention is the providing of at least one thermal insulating layer between heating plate and ball element for hindering heat drop to the arranged elements of the lower section of the sealing contour plate which on the one hand has as a result undesired loss of energy and on the other hand the thermal overload of the assembling elements of the sealing head.

This mentioned invention has also for the linear guiding system a different solution as the actual technical state provides. This is marked by the characteristic that the mentioned guiding bolts are firmly and rigidly adjusted on a base plate which is firmly adjusted on a support plate and the linear displacement of the sealing head takes place relative to the base plate through a displacement of the sealing head relative to the guiding bolt. The sealing head has corresponding boreholes provided for ball bearings which themselves are functioning on the guiding bolts. The change of the support point of the guiding bolt has—compared to the actual technical state—as a result a shorter lever arm for reduction of motional resistance caused by moments through bending out of line of the bolts. The ball bearings allow smooth-running of the bolts, which allow also the realization of a short work cycle.

The solution compared to the actual technical state in which the guiding bolts are adjusted with their first end at the sealing head while their other end functions in a borehole of the support plate the proposed constructive action results in an essentially improved guidance of the sealing head. Bending out of line of the guiding bolts in the guiding boreholes cannot appear with the mentioned device from the first. The friction caused by the mentioned bending out of line between bolts and boreholes with an undefined effect on the contact pressure of the sealing contour on the foil cover of the blister packs is from the first out of question.

Especially lateral motions of the sealing head are omitted because of the rigid adjusting of the guiding bolts on the base plate which with the usual conventional carrying out of the linear guiding are available. The cause is the clearance between borehole in the support plate and the guiding bolt and which hinder an exact location of the sealing contour relative to the convexity of the lower plastic receptacle.

Moreover the carrying out of the sealing head with ball bearings eliminates as far as possible the friction between guiding bold and sealing head at a linear displacement of the sealing head and avoids herewith also undefined effects on the contact pressure of the sealing contour.

Special attention at the mentioned invention for sealing blister packs is located on a maintenance-friendly assembly. As already mentioned essential elements such as contour plate, heating plate or rubber bearing are free and easily accessible carried out, separable together joint and without disassembly of other elements changeable. Moreover there is as a characteristic of this invention a module assembly provided with which

- a sealing head with
  - a contour plate
  - a heating plate
  - a or several insulating plates,
  - a joint element
- and
- a spring seat plate,
- two guiding bolts,
- two spring elements on the base plate assembled and therefore form an independent unit, the sealing position. Moreover there are several of the mentioned sealing positions for example four, on the same base plate arranged and form in this kind a larger unit, the sealing row. Several sealing rows, for example five, are also separable on the support plate assembled and finally form together the base unit of the device, the sealing station. The electrical cables will be supported to the base plate in this carrying out by each a multipolar connector, each engaged with a complementary formed connector. Advantageous is a definite relation of the base plate to the support plate for securing that no wrong assembly or assembly with mistakenly exchanged sides assembly takes place. Therefore the change can also take place with temporary workers.

The proposed assembly secures a simple changeability of the sealing rows and the sealing station. Together with the above mentioned actions, which secure the simple change of the essential single elements there is also an easiness to maintain and repair and an easy mode of application. Moreover the proposed assembly allows simple measuring and adjusting of the necessary temperatures and the force which is exercised from the sealing head onto the pack which has to be sealed. Herewith a measuring instrument with sensors for each sealing contour plate is arranged on the sealing station, the actual values of the temperature and the contact pressure investigated and subsequently the heating and the lever adjusting individually on each sealing head onto each set value well-regulated.

More details, characteristics and advantages of this invention you can learn from the following part of the description. In this part an example for carrying out of the inventive device for sealing blister packs will be commented with a drawing.

BRIEF DESCRIPTION OF THE DRAWING FIGS

FIG. 1: shows in a schematic representation a diameter of a sealing and

Figure 2:
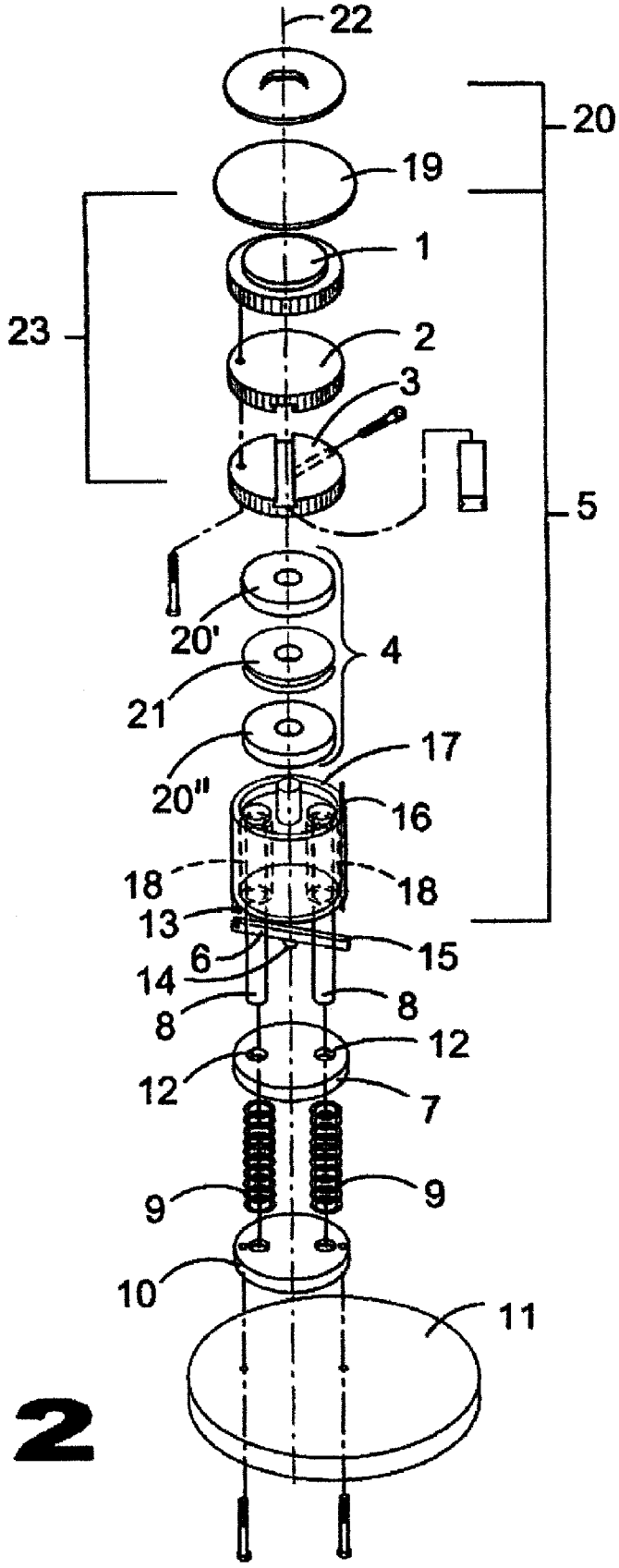

FIG. 2: shows an exploded view of the components of the apparatus of FIG. 1.

DETAILED DESCRIPTION OF THE PREFERRED EMBODIMENTS

FIG. 1 and FIG. 2 show the fundamental assembly of a unit, which is above mentioned and described as a sealing position. It represents a complete unit for producing a sealing contour and encloses the following elements: contour plate 1, heating plate 2, insulating plate 3, joint element 4, sealing head 5, lever element 6, spring seat plate 7, guiding bolt 8, spring element 9, base plate 10, support plate 11.

Due to a characteristic of the invention, the guiding bolts 8 are rigid adjusted in the base plate 10 whereas the base plate itself is separable assembled with the support plate 11. As discussed herein, the spring elements are formed as coil springs which enclose bolt 8 and are arranged in the space between base plate 10 and spring seat plate 7. As shown in FIGS. 1-2, the spring seat plate 7 has boreholes 12 which make possible a relative displacement of the spring seat plate 7 to the guiding bolts 8. A displacement of the spring seat plate 7 into the direction of the support plate 11 leads to a contraction of the springs 9 and consequently to a increase of the spring initial tension.

The displacement of the spring seat plate 7 can be activated with a single armed lever handle 6 which is guided in point 13 on the sealing head 5. The lever is formed in such a way, that its first lever arm with its free end 14 pushes against the spring seat plate 7 and its second lever arm with its free end 15 pushes against an adjusting screw, whose position in the mentioned drawing is indicated with a line-dotted line 16. The position is chosen such as that the adjusting screw can be reached from the face side 17 of the sealing head 5.

Marked with 18 are the ball bearings in which boreholes with corresponding diameters of the sealing head 5 are arranged. They allow after the attachment of the sealing head onto the foil cover 19 of the blister pack 20 the linear displacement of the sealing head 5 onto the guiding bolt 8 into the direction of the support plate 11. The force produced by the initial tension of the spring elements 9 are transferred herewith onto the contour plate 1 and provides an even contact pressure onto foil cover 19.

For the quality of the sealing is decisive not only the exactly measured contact pressure but also a clean appliance of the contour plate 1 onto the foil cover 19. Therefore the here mentioned inventive device is equipped with a joint element 4 which consists out of two metal plates 20', 20" and a rubber layer 21 which is enclosed between the plates. This element makes a tilting of the contour plate 1 in all perpendicular directions about the axis 22 possible but hinders a twisting of the mentioned axis.

The rubber bearing 4 secures that the contour plate 1 is always parallel adjusted to the surface of the foil cover 19 and no twisting about the axis 22 takes place.

At the rubber bearing 4 the sealing contour support 23 will be applied with all the necessary elements for sealing. This consists of contour plate 1 and heating plate 2. Both components are formed as independent elements and joint with each other but separable. For hindering a temperature drop from these elements into the direction of the rubber bearing 4 there is assigned between heating plate 2 and the joint element 4 a thermal insulating plate 3.

As a result the here mentioned inventive device ensures a simple and quick adjustment of the contact pressure, a high sealing quality, an optimal accessibility to all assembly elements and negligible failure frequency.

The invention claimed is:

1. An apparatus for sealing tray-shaped or pot-shaped receptacles, comprising:

a sealing head having a sealing contour plate and a heatable sealing contour;

a support plate;

means for linearly displacing said sealing head relative to said support plate;

a spring impinging said sealing head and said support plate, said spring exerting a force biasing away from said support plate;

a spring seat plate between said sealing head and said support plate, said spring seat plate being arranged in a direction that is the same as a direction of linear displacement of said sealing head; and, a joint for tilting said sealing contour plate of said sealing head perpendicularly to an axis of said means for linearly displacing said sealing head relative to said support plate, said joint consisting of a rubber bearing made of two metal plates and a rubber layer between said two metal plates.

2. The apparatus for sealing tray-shaped or pot-shaped receptacles according to claim 1, wherein said sealing contour plate is made of a hardened material.

3. The apparatus for sealing tray-shaped or pot-shaped receptacles according to claim 1, wherein said sealing contour plate is made of refined steel.

4. The apparatus for sealing tray-shaped or pot-shaped receptacles according to claim 1, wherein said means for linearly displacing said sealing head relative to said support plate includes an adjustable guiding bolt.

5. The apparatus for sealing tray-shaped or pot-shaped receptacles according to claim 4, further comprising a base plate with said adjustable guiding bolt being adjustable at said base plate.

6. The apparatus for sealing tray-shaped or pot-shaped receptacles according to claim 5, wherein said means for linearly displacing said sealing head is activated relative to said base plate with a displacement of said sealing head to said adjustable guiding bolt.

7. The apparatus for sealing tray-shaped or pot-shaped receptacles according to claim 1, further comprising means for adjusting distance between said spring seat plate and said support plate, said means for adjusting distance being between said spring seat plate and said sealing head.

8. The apparatus for sealing tray-shaped or pot-shaped receptacles according to claim 7, wherein said means for adjusting distance includes a lever handle having a first lever arm able to push with its free end against said spring seat plate or said sealing head and a second lever arm able to push with its free end against an adjusting screw.

9. The apparatus for sealing tray-shaped or pot-shaped receptacles according to claim 8, wherein said adjusting screw is accessible from a face side of said sealing head, said face side being a side of said sealing head pointed away from said support plate.

10. The apparatus for sealing tray-shaped or pot-shaped receptacles according to claim 8, wherein said adjusting screw encloses a cylindrical pin relocatable to a direction of its axis and a headless screw with a hexagonal socket head, said cylindrical pin being between said second lever arm and said headless screw.

* * * * *